US011078002B2

(12) United States Patent
Weyrauch et al.

(10) Patent No.: US 11,078,002 B2
(45) Date of Patent: Aug. 3, 2021

(54) PALLET CONTAINER

(71) Applicant: MAUSER-WERKE GMBH, Bruehl (DE)

(72) Inventors: Detlev Weyrauch, Kreuzau-Untermaubach (DE); Stefan Adolfs, Hürth-Fischenich (DE)

(73) Assignee: MAUSER-WERKE GMBH, Bruehl (DE)

( * ) Notice: Subject to any disclaimer, the term of this patent is extended or adjusted under 35 U.S.C. 154(b) by 0 days.

(21) Appl. No.: 16/329,386

(22) PCT Filed: Sep. 12, 2017

(86) PCT No.: PCT/EP2017/001074
§ 371 (c)(1),
(2) Date: Feb. 28, 2019

(87) PCT Pub. No.: WO2018/046131
PCT Pub. Date: Mar. 15, 2018

(65) Prior Publication Data

US 2019/0225400 A1 Jul. 25, 2019

(30) Foreign Application Priority Data

Sep. 12, 2016 (DE) ..... 202016005519.5

(51) Int. Cl.
*B65D 77/04* (2006.01)
*B65D 19/02* (2006.01)

(52) U.S. Cl.
CPC ..... *B65D 77/0466* (2013.01); *B65D 19/02* (2013.01); *B65D 2519/00024* (2013.01);
(Continued)

(58) Field of Classification Search
CPC ..... B65D 19/02; B65D 77/0466; B65D 19/10
(Continued)

(56) References Cited

U.S. PATENT DOCUMENTS 6,202,844 B1 3/2001 Sedlmayr
6,668,735 B2 * 12/2003 Cassina ..... B65D 19/004 108/55.1
(Continued)

FOREIGN PATENT DOCUMENTS

AU 2003203850 A1 11/2003
CN 1475418 A 2/2004
(Continued)

OTHER PUBLICATIONS

Written Opinion for International Application No. PCT/EP2017/001074, dated Jan. 5, 2018.
(Continued)

*Primary Examiner* — Rafael A Ortiz
(74) *Attorney, Agent, or Firm* — Marshall, Gerstein & Borun LLP

(57) ABSTRACT

A pallet container for storage and for transport of hazardous liquid or flowable materials includes a thin-walled rigid inner container made from thermoplastic, with a tubular lattice frame surrounding the inner container and having horizontal and vertical tubular rods welded together, and a rectangular base pallet supporting the inner container and connected to the tubular lattice frame. Two parallel rod-shaped crossbars extend across the top, laterally next to the upper filler neck of the cube-shaped inner container, to which the top of the inner container is fastened by means of two holders. The holders are formed in the course of the upper pinch-off seam from the plastic material of the inner container during blow molding. The top of the plastic inner container is fitted with two solid stable crossbar supporting pins which are open at the side and each engage over the two crossbars.

6 Claims, 3 Drawing Sheets

(52) U.S. Cl.
CPC ..... *B65D 2519/00059* (2013.01); *B65D 2519/00243* (2013.01); *B65D 2519/00532* (2013.01); *B65D 2519/00562* (2013.01)

(58) Field of Classification Search
USPC ..... 206/386, 600, 599; 108/55.1, 55.3, 108/57.15, 57.16, 57.21–57.25; 220/23.87, 23.91, 401, 400
See application file for complete search history.

(56) References Cited

U.S. PATENT DOCUMENTS

| | | | | |
|---|---|---|---|---|
| 2009/0212048 | A1 | 8/2009 | Schutz | |
| 2011/0073510 | A1* | 3/2011 | Cassina | B65D 77/0466 206/386 |
| 2012/0055830 | A1* | 3/2012 | Schutz | B65D 77/0466 206/386 |
| 2012/0279885 | A1* | 11/2012 | Schutz | B65D 19/0048 206/386 |
| 2015/0239608 | A1* | 8/2015 | Weyrauch | B65D 19/40 206/386 |

FOREIGN PATENT DOCUMENTS

| | | | | |
|---|---|---|---|---|
| CN | 101519149 | A | 9/2009 | |
| DE | 29510064 | U1 | 8/1995 | |
| DE | 19838309 | A1 | 3/2000 | |
| DE | 102007044279 | A1 * | 4/2009 | B65D 77/0466 |
| EP | 0881161 | A1 | 12/1998 | |

OTHER PUBLICATIONS

International Search Report for International Application No. PCT/EP2017/001074, dated Jan. 5, 2018.

* cited by examiner

PALLET CONTAINER

CROSS-REFERENCE TO RELATED APPLICATION

This is the United States national phase of International Patent Application No. PCT/EP2017/001074, filed Sep. 12, 2017, which claims priority to German Patent Application No. DE 20 2016 005 519.5, filed Sep. 12, 2016, the entire contents of each of which are hereby incorporated by reference herein.

FIELD OF THE DISCLOSURE

The invention relates to a pallet container (referred to below in short as "IBC") for storage and for transport of in particular hazardous liquid or flowable filling materials, with a thin-walled rigid inner container made from thermoplastic, with a tubular lattice frame which tightly surrounds the plastics inner container as a supporting casing and consists of horizontal and vertical tubular rods which are welded to one another, and with a rectangular base pallet on which the plastics container rests and to which the tubular lattice frame is fixedly connected, wherein the rectangular plastics container has two longer side walls, a shorter rear wall, a shorter front wall, a container base and a top having a central, closeable filling nozzle, wherein two crossbars run at the top of the tubular lattice frame laterally next to the filling nozzle of the plastics inner container and are fastened to the two longer side walls of the tubular lattice frame and over which two holding devices which are arranged on the top and are formed from the plastics material of the plastics inner container engage centrally.

BACKGROUND

In the chemical industry, pallet containers or IBCs to a large extent are predominantly used for transport of liquid chemicals. Said chemical products mainly constitute hazardous liquid filling materials, for the storage and transport of which only appropriately type-tested containers are permitted. During the type test carried out by the Federal Institute for Materials Testing (BAM), various strength and tightness criteria have to be met. Among other things, as simulation for continuous transport vibrations, for IBCs a so-called "vibration test" has to be completed on a vibrating table which exerts extremely high dynamic vibrating loads on the filled pallet container within a very short period of time. The correspondingly driven vibrating table carries out short vertical lifting movements with a double amplitude of 25 mm±5%, with the frequency of the lifting movements being selected such that the pallet container with its base pallet just lifts off the supporting plate of the vibrating table. The test lasts for an hour. The tested pallet container must then not have any leak, any fracture and any rupture/failure of the structural equipment.

In terms of function, each time the vibrating table abruptly moves upward, a strong hydrodynamic shockwave acts on the liquid column located in the inner container, as a result of which the liquid endeavors to swerve laterally. The side walls of the surrounding lattice cage are thereby pressed elastically outward (in four directions). At the same time, the top with the screw cap on the central filling opening sinks heavily downward. During the subsequent abrupt moving downward of the vibrating table, the outwardly pressed side walls of the lattice cage spring back and the liquid now swerves upward (only in one direction), with the top with the screw cap being vigorously knocked upward. The rapid periodic repetitions of said movement sequences may cause the liquid or the entire container system to enter into resonant vibrations, as a result of which the size of the swerving movements increases further and quickly exceeds critical values, which can lead to tubular rod fractures and tearing open of welded joints of the welded tubular rod junctions.

Pallet containers of the present type with a thin-walled plastics inner container and a surrounding tubular lattice frame ("composite IBCs") are customarily provided with two tubular-rod-shaped crossbars which run over the top of the plastics inner container laterally next to the filling nozzle and are fastened to the uppermost, horizontally encircling tubular rod of the tubular lattice frame. This serves firstly for stiffening the upper lattice frame region and secondly for securing the plastics inner container within the tubular lattice frame. The intention here, inter alia, is to prevent, for example, if a pallet container is overturned, the filled plastics inner container from slipping out of the lattice cage and no longer being able to be handled.

Document EP 0 881 161 A1 discloses a similar pallet container with a removable metal or plastics protected cover, in which collapsing of the top with the filling nozzle of the plastics inner container due to the action of external or internal forces is intended to be avoided. In this case, in particular a lowering of the top due to the build-up of a negative pressure during cooling of the filling material is to be counteracted, so that the screw cap can continue to be opened by means of commercially available wrenches. The intention is also to avoid said top from lowering when an agitating tool is placed onto the filling nozzle. For this purpose, the top of the plastics inner container is fastened to the protective cover arranged thereabove. Two fastening eyelets which are plugged through slots in the protective cover and protrude upward are integrally formed on the top. To secure the top to the protective cover, corresponding split pins are plugged through the protruding fastening eyelets.

The pallet containers of the type in question that are currently on the market and are from various manufacturers virtually all have, as holding devices, closed fastening eyelets which are integrally formed on the top and engage over the two crossbars on the upper lattice cage.

However, these known fastening eyelets are comparatively thin and have a large through opening because, during the installation of the crossbars, the latter have to be plugged with their angled fastening ends through the eye of the fastening eyelets. Accordingly, this does not constitute a stable suspension of the inner container for the approval testing for hazardous goods, in particular the vibration test.

GENERAL DESCRIPTION

The present invention is based on the object of increasing the stability of pallet containers against the external action of vibration loads by a bit in a simple manner and therefore of extending the service life of the pallet containers overall.

In a surprisingly simple manner, the proposed technical teaching opens up the capability of filled pallet containers to provide improved resistance to continuous transport vibrations. By means of the structural measures of the present invention, the entire pallet container system achieves an increase in performance that takes effect in the event of dynamic permanent loading only in the upper limit range.

The present invention is distinguished in a structural manner in that the holding devices are designed as solid supporting pins which are open on the one side, with a short free end and a comparatively long connecting region. The comparatively long connecting region of the supporting-pin-shaped holding devices here is approximately twice as long as the short free end. Several advantages are thereby simultaneously obtained.

Firstly, a substantial advantage in terms of manufacturing is obtained. The crossbars no longer have to be plugged with their comparatively large angled fastening ends through a closed fastening eyelet by hand, but rather can be pushed in a simple manner from the side under the short free end of the supporting pin. This operation can easily be automated.

Secondly, with regard to the approval testing, the pallet container has increased rigidity because of the supporting pin with the long connecting region on the top of the inner container and the solid, short design of the free end of the supporting pin. In conjunction with the solid design of the free supporting-pin end, the clearance below the end with respect to the top is specifically only of a size such that the crossbar fits precisely thereunder and fills the available clearance, and therefore excess clearance no longer remains and no hitherto customary free movement (striking) of the crossbar in a large eyelet opening can take place any longer. On the contrary, permanent contact securing between supporting-pin-shaped holding devices and crossbar now exists during each up and down movement of the inner container top without free movement and striking of the crossbar.

In a refinement of the invention, it is expediently provided that the two supporting-pin-shaped holding devices are formed facing each other with their free end. The effect achieved by this is that, even in the event of extreme vibration loading in the resonance range, the crossbars do not simply spring out under the free ends of the supporting pins.

In a structural refinement, the supporting-pin-shaped holding devices overall have a rectangular cross section, wherein the height is approx. 35 mm to 45 mm—preferably 38 mm, the length is approx. 65 mm to 80 mm—preferably 72 mm, and the thickness is approx. 5 mm to 8 mm—preferably 6 mm. The supporting-pin-shaped holding devices are therefore virtually twice as long as they are high and have improved rigidity in comparison to known thin fastening eyelets. This is also brought about by the fact that the short free end has a length of "only" approx. 18 mm to 25 mm—preferably 22 mm—and a free height or a small distance from the top of the inner container of approx. 15 mm to 20 mm—preferably 17 mm.

In a further structural refinement, it is provided that the connecting region of the supporting-pin-shaped holding devices is formed exclusively in the obliquely running transition region of the inner container. By means of the arrangement of the long connecting region of the solid supporting pins in the obliquely running transition region of the inner container from the two higher outer parts to the lower central part (for the protected arrangement of the filling screw cap), a reduction in the peak values of the up and down movement of the inner container top is brought about, which ultimately leads to a noticeable increase in the resistance capability in the event of a long lasting vibration loading.

BRIEF DESCRIPTION OF THE DRAWINGS

The invention will be explained and described in more detail below with reference to an exemplary embodiment which is illustrated schematically in the drawings, in which.

DETAILED DESCRIPTION

Figure 1:
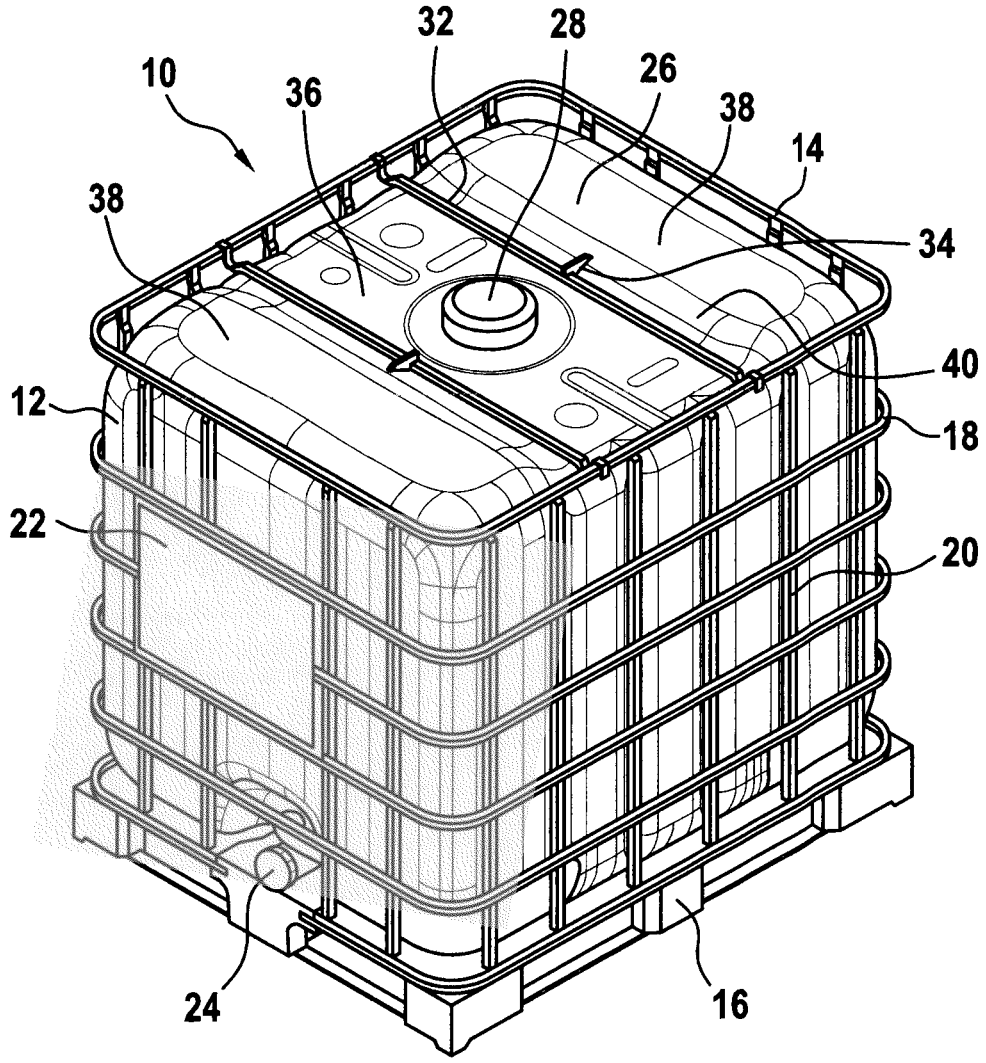
FIG. 1: shows an IBC according to the invention in a perspective oblique view.

In FIG. 1, a pallet container according to the invention (=IBC) for storage and for transport of in particular hazardous liquid or flowable filling materials is denoted by the reference sign 10. For utilization or for use of hazardous filling materials, the pallet container 10 meets particular test criteria and is provided with an appropriate official hazardous goods permit. In a design for a filling material volume of approx. 1000 l, the pallet container 10 has standardized dimensions with a length of approx. 1200 mm, a width of approx. 1000 mm and a height of approx. 1151 mm. The main elements of the pallet container 10 comprise a thin-walled rigid inner container 12 produced from thermoplastic by blow molding, a tubular lattice frame 14 tightly surrounding the plastics inner container 12 as a supporting casing, and a base pallet 16 on which the plastics inner container 12 rests and to which the tubular lattice frame 14 is fixedly connected. The outer tubular lattice frame 14 consists of horizontal and vertical tubular rods 18, 20 which are welded to each other. In order to obtain a closed lattice cage as an outer container, the annularly encircling horizontal tubular rods 18 are each fixedly connected to one another at a connecting point. In the version shown, the base pallet 16 is designed as a composite pallet with an upper steel-sheet supporting plate, with a steel tube supporting frame arranged underneath and with plastics corner and central feet. An identification panel 22 made from thin steel sheet is fastened on the front side of the tubular lattice frame 14 in order to identify the respective liquid filling material. An extraction nozzle 24 for the connection of an extraction fitting for extracting the liquid filling material is formed in the center of the base of the plastics inner container 12.

Corresponding to the dimensions of the pallet container 10, the plastics inner container 12 has two longer side walls, a shorter rear wall, a shorter front wall, a container base and a top 26 with a centrally arranged filling nozzle 30 which is closeable by means of a screw cap 28, wherein two tubular-rod-shaped crossbars 32 run at the top of the tubular lattice frame 14 laterally next to the filling nozzle 30 of the plastics inner container 12 and are fastened to the two longer side walls of the tubular lattice frame 14 and over which two solid supporting-pin-shaped holding devices 34 which are arranged on the top 26 and are formed from the plastics material of the plastics inner container 12 engage centrally.

Figure 2:
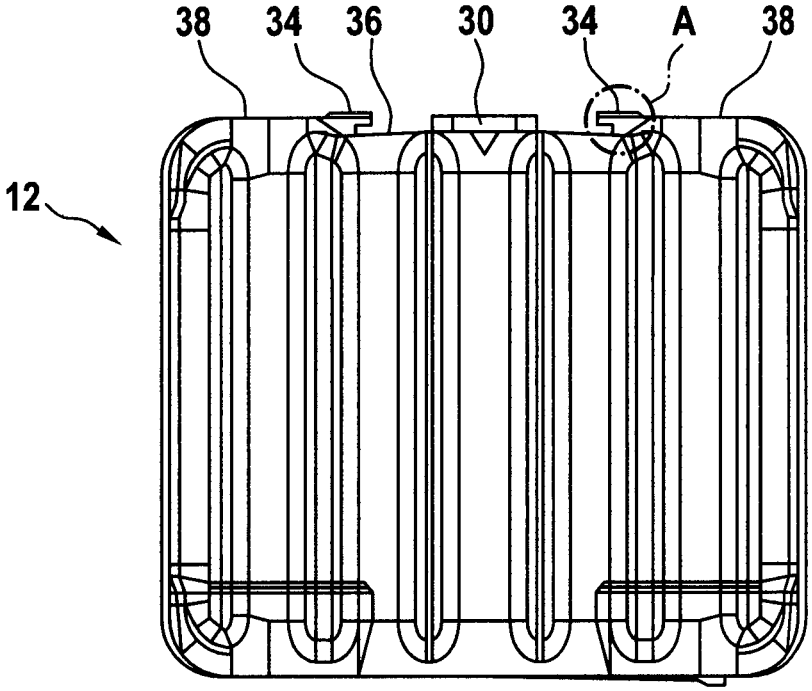
FIG. 2: shows a plastics inner container in side view.

The cube-shaped plastics inner container 12 is illustrated by itself (without the surrounding tubular lattice frame 14) in side view in FIG. 2. The base-side extraction nozzle 24 is arranged on a shorter side wall which is not visible here. The upper centrally arranged filling nozzle 30 is positioned in a lower central part 36 of the inner container 12 between two higher outer parts 38. The two solid supporting-pin-shaped holding devices 34 which are open on one side are arranged in the obliquely formed transition regions 40 from the lower central part 36 to the two higher outer parts 38.

During the blow molding operation, when the blow mold is closed, the holding devices 34 are formed in the region of the pinch-off seam from the pinched-off tube ends in depressions formed for this purpose. In the case of the previously customary closed fastening eyelets, the plastics material in the eyelet openings have had to be cut out separately after each blow molding operation. This additional working step is advantageously omitted in the case of the inventive supporting-pin-shaped holding devices 34 which are open on one side.

Figure 3:
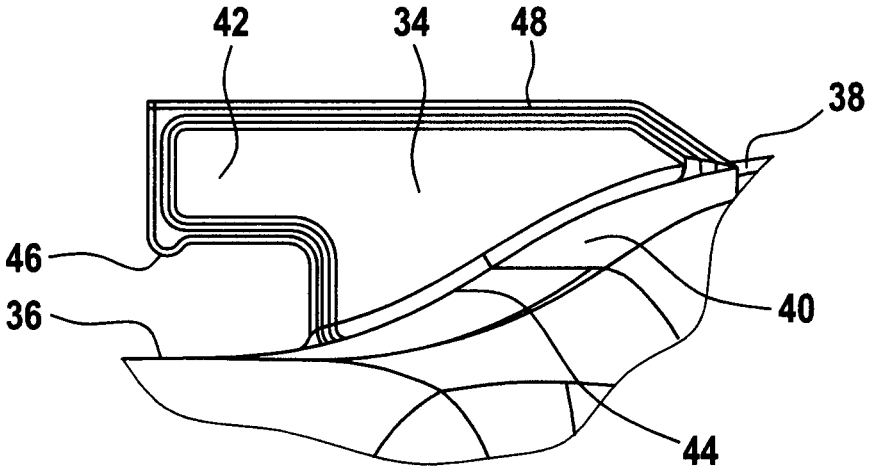
FIG. 3: shows the cutout of a detail from FIG. 2 with a supporting-pin-shaped holding device.

The enlarged illustration in FIG. 3 makes it clear that the holding devices 34 are designed as solid supporting pins which are open on one side, with a short free end 42 and a comparatively long connecting region 44. It was apparent in the previous illustrations FIG. 1 and FIG. 2 that the holding devices 34 are formed facing each other with their free end 42.

According to a structural refinement, the comparatively long connecting region 44 of the supporting-pin-shaped holding devices 34 is approximately twice as long as the short free end 42. The holding devices 34 here have overall a rectangular cross section, wherein the height is approx. 35 mm to 45 mm—preferably 38 mm, the length is approx. 65 mm to 80 mm—preferably 72 mm —, and the thickness is approx. 5 mm to 8 mm—preferably 6 mm. The supporting-pin-shaped holding devices 34 are therefore virtually twice as long as they are high. The contact-bound clamping of the crossbars (without a clearance as in a closed plug-through eyelet) takes place by the fact that the short free end 42 has a length of approx. 18 mm to 25 mm—preferably 22 mm—and a free height or a distance from the top 26 of the inner container of approx. 15 mm to 20 mm—preferably 17 mm.

As is furthermore clearly revealed in FIG. 3, the connecting region 44 of the supporting-pin-shaped holding devices 34 is formed exclusively in the obliquely running transition regions 40 of the inner container top 26. In order to completely rule out the crossbars 32 springing out under the holding devices 34, the two holding devices 34 are provided at their free end 42 with a small downwardly pointing lug 46.

Figure 4:
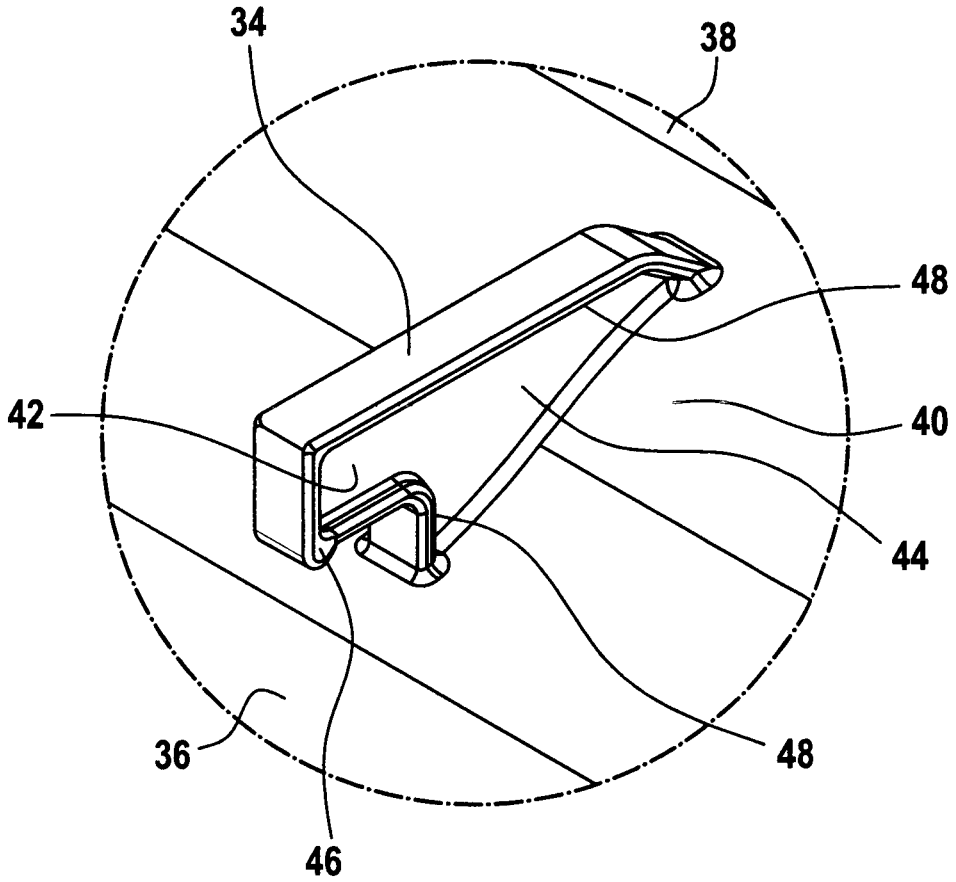
FIG. 4: shows a perspective oblique view of the holding device according to FIG. 3.

In addition, the perspective view in FIG. 4 clearly shows that the two lateral outer edges of the supporting-pin-shaped holding devices 34 are provided with a continuous edge bead 48.

The edge bead 48 has a width of approx. 3 mm and a height of approx. 1 mm.

This increases the rigidity of the holding device, wherein a certain required elasticity is maintained in order to be able to cushion the impacts from reversing the direction during the pivoting of the top up and down during the vibration test and to transmit said impacts only to a reduced extent to the crossbars 32.

In comparison tests of vibration tests with video recording, it can be seen in a standard IBC with a known closed eyelet having a large through opening that the top with the thin eyelet strikes overall with a higher vibration amplitude and thereby with more momentum against the cross member because, as the top moves upward, the thin eyelet is raised from the cross member rod and, when the top moves downward, said eyelet strikes abruptly against the cross member whereas the open holding device is still resting on the cross member rod also in the upper turning point of the top and does not lift. As a result, the vertical "pulsing" in the two higher outer side regions or outer parts of the top is noticeably reduced and the vibration amplitude of the horizontal "pulsing" in the region of the two opposite longer side walls of the lattice cage or of the pallet container 10 is reduced. Measurements of the maximum elastic deflection of the opposite longer side walls of the lattice cage under dynamic loading have revealed that, in the case of the contact-bound form-fitting suspension of the inner container top 26 on the crossbars 32 by means of the solid supporting-pin-shaped holding devices 34 which are open on one side, a lattice deflection which is approx. 20% smaller takes place. This gives rise to significantly lower peak values of critical changing bending stresses and harmful tensile stresses on the sensitive welding points of the welded tube junctions in the lattice cage. This accounts for a longer service life and usability of the pallet containers according to the invention.

The present invention therefore, with comparatively small measures, provides a valuable step in respect of increasing value by reusing used IBCs for longer.

The invention claimed is:

1. A pallet container for storage and for transport of in particular hazardous liquid or flowable filling materials, with a thin-walled rigid inner container made from thermoplastic, with a tubular lattice frame which tightly surrounds the plastics inner container as a supporting casing and consists of horizontal and vertical tubular rods which are welded to one another, and with a rectangular base pallet on which the plastics inner container rests and to which the tubular lattice frame is fixedly connected, wherein the cube-shaped plastics inner container has two longer side walls, a shorter rear wall, a shorter front wall, a container base and a top having a centrally arranged filling nozzle which is closeable by means of a screw cap, wherein two tubular-rod-shaped crossbars run at the top of the tubular lattice frame laterally next to the filling nozzle of the plastics inner container and are fastened to the two longer side walls of the tubular lattice frame and over which two holding devices are arranged on the top and are formed from the plastics material of the plastics inner container engage centrally, characterized in that the holding devices are in the form of solid supporting pins which are open on one side with a short free end and a comparatively long connecting region, on the top of the plastics inner container, wherein the open side of the supporting pins is between a surface of the container and a surface of the short free end, whereby the supporting pins facing each other with their free end, and the comparatively long connecting region of the supporting pins on the top of the inner container are approximately twice as long as the short free end.

2. The pallet container as claimed in claim 1, characterized in that the supporting pins have a rectangular cross section, wherein the height is between 35 mm to 45 mm—preferably 38 mm, the length is between 65 mm to 80 mm—preferably 72 mm, and the thickness is between 5 mm to 8 mm—preferably 6 mm.

3. The pallet container as claimed in claim 1, characterized in that the short free end of the supporting pins has a length of between 18 mm to 25 mm—preferably 22 mm—and a free height or a distance from the top of the inner container of 15 mm to 20 mm—preferably 17 mm.

4. The pallet container as claimed in claim 1, characterized in that the long connecting region of the supporting pins is formed exclusively in an obliquely running transition region of the inner container top.

5. The pallet container as claimed in claim 1, characterized in that the supporting pins are provided at their free end with a small downwardly pointing lug.

6. The pallet container as claimed in claim 1, characterized in that the supporting pins include two lateral outer edges, with a continuous edge bead, which has a width of approx. 3 mm and a height of approx. 1 mm.

* * * * *